US006377696B1

(12) United States Patent
Nevill

(10) Patent No.: US 6,377,696 B1
(45) Date of Patent: Apr. 23, 2002

(54) LOUDSPEAKER SYSTEMS

(75) Inventor: Stuart Michael Nevill, Kent (GB)

(73) Assignee: B & W Loudspeakers Limited, Worthing (GB)

( * ) Notice: Subject to any disclaimer, the term of this patent is extended or adjusted under 35 U.S.C. 154(b) by 0 days.

(21) Appl. No.: 09/403,198

(22) PCT Filed: Apr. 29, 1998

(86) PCT No.: PCT/GB98/01251

§ 371 Date: Oct. 15, 1999

§ 102(e) Date: Oct. 15, 1999

(87) PCT Pub. No.: WO98/51121

PCT Pub. Date: Nov. 12, 1998

(30) Foreign Application Priority Data

May 2, 1997 (GB) ..... 9709109

(51) Int. Cl.[7] ..... H04R 25/00

(52) U.S. Cl. ..... 381/345; 381/338; 381/348; 181/199

(58) Field of Search ..... 381/307, 332, 381/334, 335, 336, 337, 338, 339, 340, 341, 345, 346, 348, 353, 354; 181/145, 146, 153, 151, 199

(56) References Cited

U.S. PATENT DOCUMENTS

| | | | | |
|---|---|---|---|---|
| 3,473,625 A | * | 10/1969 | Heisrath | 381/348 |
| 3,486,578 A | * | 12/1969 | Albarino | 381/348 |
| 4,154,970 A | | 5/1979 | Barker | |
| 5,012,890 A | | 5/1991 | Nagi et al. | |
| 5,815,589 A | * | 9/1998 | Wainwright et al. | 381/353 |

FOREIGN PATENT DOCUMENTS

| | | |
|---|---|---|
| DE | 86 29 084.3 | 4/1987 |
| DE | 91 02 192 | 5/1991 |
| DE | 42 23 572 C1 | 1/1994 |
| EP | 295 641 A2 | 12/1988 |
| EP | 332 053 A2 | 9/1989 |
| EP | 334 238 A2 | 9/1989 |
| EP | 336 303 A2 | 10/1989 |
| FR | 705 640 | 6/1931 |
| GB | 752651 | 7/1956 |
| GB | 2 187 361 A | 9/1987 |
| GB | 2 290 672 A | 1/1995 |
| GB | 2 283 150 A | 4/1995 |
| JP | 60-105398 | 6/1985 |
| JP | 60-105399 | 6/1985 |

* cited by examiner

*Primary Examiner*—Curtis Kuntz
*Assistant Examiner*—Suhan Ni
(74) *Attorney, Agent, or Firm*—Burns, Doane, Swecker & Mathis, L.L.P.

(57) ABSTRACT

The loudspeaker system includes a loudspeaker drive unit (2) and a tube (4) acoustically coupled to the rear of the loudspeaker drive unit for leading away and absorbing sound waves produced at the rear of the loudspeaker drive unit. The tube is acoustically coupled to the loudspeaker drive unit by a hollow resonant enclosure (6) and the loudspeaker drive unit is mounted at an aperture (8) in an external wall of the enclosure. The tube communicates with the interior of the enclosure and extends outwardly from the enclosure. There is a significant change in acoustic impedance where the tube communicates with the interior of the enclosure. The fundamental resonant frequencies of the enclosure and the tube each lie between the first and second frequencies but the Helmholtz resonant frequency of the tube, when its distal end is open, lies below the first frequency. The effect of the enclosure is to "short circuit" sound at the frequencies of the higher order resonances of the tube so that those resonances are not excited to any significant extent.

19 Claims, 2 Drawing Sheets

LOUDSPEAKER SYSTEMS

BACKGROUND OF THE INVENTION

1. Field of the Invention

This invention relates to loudspeaker systems.

2. Description of Related Art

GB-A-2 290 672 discloses a loudspeaker system comprising a bass unit, a mid-range unit, a treble unit, and a tweeter unit. Each of the units includes a respective loudspeaker drive unit. The mounting for the loudspeaker drive unit is such that there is substantially no rear reflecting surface behind the diaphragm of the loudspeaker drive unit. The pole piece of the respective magnet system of each loudspeaker drive unit is provided with an aperture through which, in use, sound from the rearward side of the diaphragm passes. Each of the loudspeaker drive units has a respective circular-section tube extending from the rear of the loudspeaker drive unit. Each tube contains sound-absorbent material such as glass fibre and tapers away from the associated loudspeaker drive unit.

The tapering tube is acoustically coupled to the rear of a loudspeaker drive unit to lead away and absorb sound waves produced at the rear of the loudspeaker drive unit. Such an arrangement is, however, satisfactory to the ear over only a certain bandwidth and that has the disadvantage that it is necessary to employ at least four such loudspeaker systems in combination, each to reproduce a respective part of the audio spectrum, if true high fidelity sound reproduction is to be obtained. Such combination systems are, of course, relatively expensive to manufacture.

EP-A-0 332 053 discloses an acoustic apparatus for improved bass sound reproduction which comprises a resonator, a vibrator, and a vibrator drive means. A Helmholtz resonator having an opening port and a neck serving as a resonance radiation unit is used as a resonator which is an acoustic radiation member. In the Helmholtz resonator, a resonance phenomenon of air is caused by a closed cavity (hollow drum) formed in a body portion and a short tube or duct constituted by the opening port and the neck.

FR-A-705 640 discloses a loudspeaker drive unit within a conical enclosure, which enclosure terminates in a very long tube rolled into a spiral. A series of holes are provided along the length of the tube and make connection to the external air. Sound waves in opposite phase are supposed to emerge from the holes and cancel each other out.

Objects and Summary

It is an object of the invention to overcome or mitigate the above-mentioned disadvantage of the prior art.

The present invention provides a loudspeaker system for reproducing signals between a first, lower frequency and a second, higher frequency of the audio spectrum, the system comprising:

a loudspeaker drive unit and a tube acoustically coupled to the rear of the loudspeaker drive unit for leading away and absorbing sound waves produced at the rear of the loudspeaker drive unit, wherein:

the tube is acoustically coupled to the loudspeaker drive unit by means of a hollow resonant enclosure and the loudspeaker drive unit is mounted at an aperture in an external wall of the enclosure;

the tube communicates with the interior of the enclosure, extends outwardly from the enclosure, and is closed to the external surroundings along its length; and there is a significant change in acoustic impedance where the tube communicates with the interior of the enclosure; characterized in that:

a crossover network is provided to define the first, lower and second, higher frequencies of sound reproduction of the system;

the fundamental resonant frequencies of the enclosure and the tube each lie between the first, lower and second, higher frequencies of sound reproduction of the system but the Helmholtz resonant frequency of the tube, as hereinbefore defined, lies below the first, lower frequency of sound reproduction of the system, and means are provided to prevent the emergence of sound waves from the distal end of the tube.

The Helmholtz resonance frequency of the tube is here defined as the resonance frequency that occurs when the tube is open at both ends and the mass of air within it bounces on the stiffness of the air in the enclosure. The tube may, however, be closed at its distal end, in which case, the Helmholtz resonance frequency here defined can be determined by making the experiment of opening the closed end.

The invention is based on the realization that sound waves can bounce from side to the side in the tube of a loudspeaker system of the above-mentioned patent application so creating higher order resonances which can have an adverse effect on sound reproduction if they lie within the band that loudspeaker system is to reproduce.

When, in accordance with the present invention, the enclosure is provided and there is a significant change in acoustic impedance where the tube communicates with the enclosure, the enclosure acts, effectively, as a "short circuit" to sound at the frequencies of the higher order resonances of the tube so that those resonances are not excited to any significant extent. The effect of the tube is effectively to remove energy from the resonances of the enclosure. Thus, the enclosure and tube act, so to speak, for the mutual benefit of each other. It is therefore possible to design the loudspeaker system to work over a frequency band that includes the higher order resonances of the tube.

Because the loudspeaker system can then be designed to work over a wider bandwidth, it becomes possible to use fewer loudspeaker systems in combination to cover the whole of the audio spectrum, so achieving a substantial saving in cost.

It is particularly to be noted that unlike loudspeaker systems of the prior art in which the Helmholtz resonant frequency lies within the band of operation of the system and is used to modify, by resonance, the frequency response within that band, the present invention requires the Helmholtz resonant frequency to be excluded from the band of operation of the system and to lie below it. The aim in the invention is to prevent resonance within the band of operation rather than to employ resonance within the band for a particular effect as was done in the prior art.

As is well known, loudspeaker systems for high fidelity sound reproduction have units operating over particular regions of the audio spectrum, namely, sub-woofer units for the very low bass frequencies, woofer or bass units for bass frequencies, mid-range units for the middle part of the audio spectrum, and tweeter units for high frequencies. The present invention can be applied with particular benefit to a mid-range unit.

The said Helmholtz resonant frequency may be less than one half the first frequency or less than one quarter the first frequency. Thus, in the invention there is co-operation between the enclosure and tube to overcome the effects of unwanted resonances in the tube within the pass band of the loudspeaker system rather than use of a Helmholtz resonance to extend the bass range of a loudspeaker system as in a conventional enclosure with a Helmholtz resonator.

The fundamental resonance frequency of the tube may be more than twice the first frequency.

The enclosure may be generally parallelepipedal, for example, of square or rectangular section. In such an enclosure, the resonant frequencies are related to each other by sine and cosine functions.

Alternatively, the enclosure may be generally spherical. In such an enclosure, the resonant frequencies are related to each other by a Bessel function.

The tube may taper from the point of communication with the interior of the enclosure and may taper away linearly or exponentially. For example, the tube may taper away exponentially with an exponential taper rate in the range −8 to −14.

The distal end of the tube may be open and rely on attenuation within the tube to prevent the emergence of sound waves but preferably the distal end of the tube is closed to make certain that sound waves cannot emerge from the distal end of the tube.

Preferably, sound absorbent material is provided in the interior of the enclosure. By that means the resonance of the enclosure can be damped in order to optimize its effectiveness.

Preferably, sound absorbent material is provided in the interior of the tube. By that means, reliance does not have to be placed exclusively on the attenuating effect of a taper. When the distal end of the tube is closed, sound waves reflected from the closed end meet the sound absorbent material for a second time after reflection.

The tube is particularly effective when it has a diameter approximating to that of the loudspeaker drive unit and is of length at least equal to the diameter of the loudspeaker drive unit. In the above mentioned earlier application, it was preferred that the tube be at least six times the diameter of the loudspeaker drive unit and the fact that such a long tube is no longer preferable itself indicates the remarkable benefit obtainable by the use of the present invention.

The internal volume of the enclosure may be less than 25 times the internal volume of the tube, preferably less than 10 times, yet more preferably less than 5 times, or it may be less than 3 times the internal volume of the tube. The internal volume of the enclosure is preferably in the range 3 to 10, more preferably, 4 to 8 times the internal volume of the tube.

Preferably, the tube extends rearwardly substantially along the axis of the loudspeaker drive unit. Such an arrangement is particularly satisfactory acoustically, mechanically and aesthetically.

Preferably, the loudspeaker drive unit is located on a central axis of the enclosure. Again, such an arrangement is particularly satisfactory acoustically, mechanically and aesthetically.

Preferably, the enclosure has an internal volume in the range 6 to 10 liters. Such a volume works well for a mid-range loudspeaker system.

Preferably, the tube has a length between 24 and 36 centimeters. Such a tube length works well for a mid-range loudspeaker system.

The invention also provides a multi-way loudspeaker system comprising a plurality of systems according to the invention in combination, each system being arranged to reproduce a respective part of the audio spectrum.

BRIEF DESCRIPTION OF THE DRAWINGS

Loudspeaker systems constructed in accordance with the invention will now be described, by way of example only, with reference to the accompanying drawings, in which.

DETAILED DESCRIPTION OF THE PREFERRED EMBODIMENTS

Figure 1:
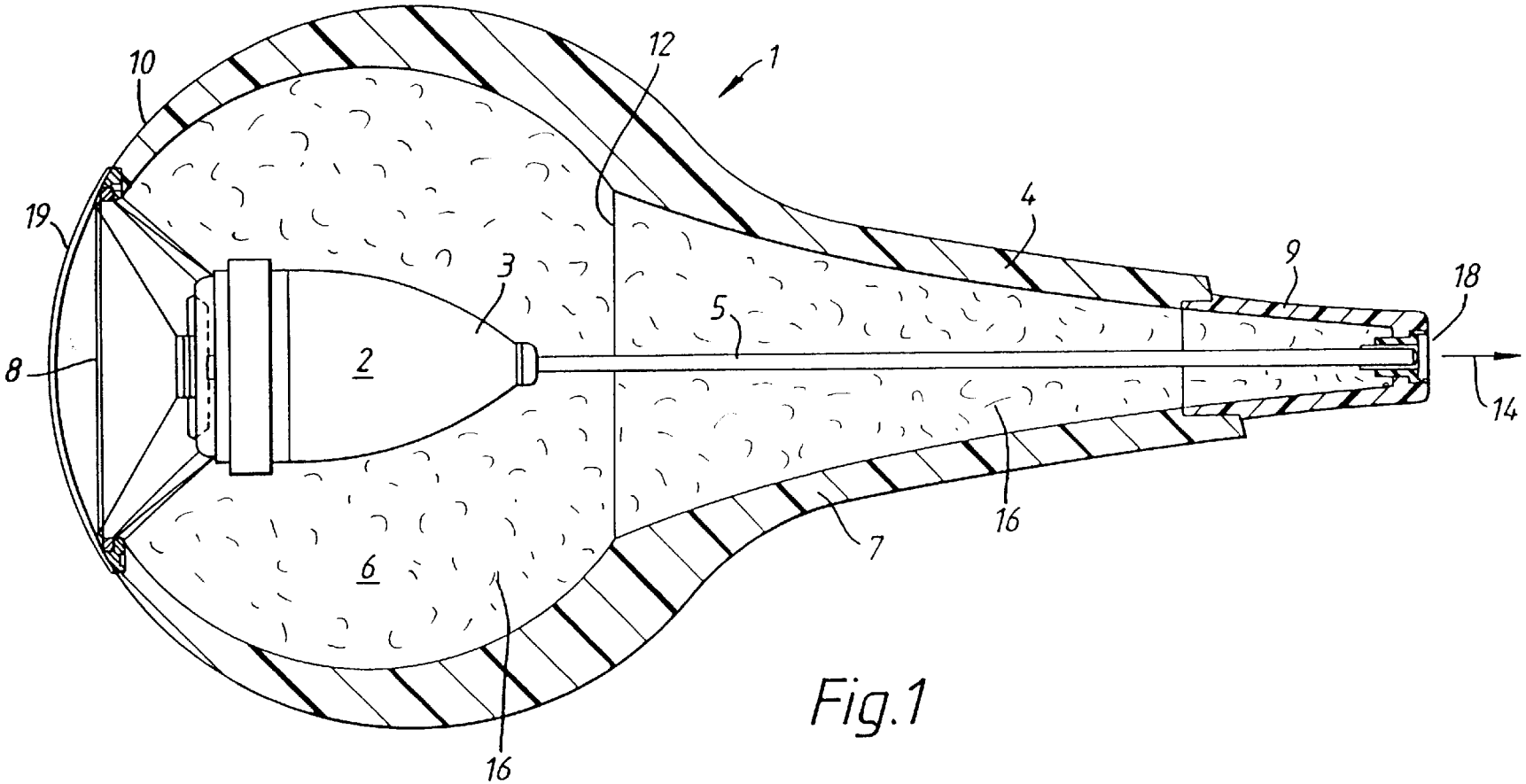
FIG. 1 is a diagrammatic cross-section through a first loudspeaker system in accordance with the invention.

Referring to the accompanying drawings, a loudspeaker system 1 comprises a loudspeaker drive unit 2 and a tube 4 acoustically coupled to the rear of the loudspeaker drive unit for leading away and absorbing sound waves produced at the rear of the loudspeaker drive unit. The tube 4 is acoustically coupled to the loudspeaker drive unit 2 by means of a hollow resonant enclosure 6 and the loudspeaker drive unit is mounted at an aperture 8 in the external wall 10 of the enclosure.

The loudspeaker drive unit 2 has an aerodynamically shaped magnet assembly 3 and an axially arranged tubular member 5 is provided to support the rear of the magnet assembly.

The enclosure 6 is of a thick-walled plastics material and is integrally-formed with a first section 7 of the tube 4. A continuation piece 9 continues the tube 4 to its distal end 18. An acoustically-transparent grill 19 is provided over the aperture 8 for aesthetic reasons.

The tube 4 communicates by way of its mouth 12 with the interior of the enclosure 6 and extends outwardly from the enclosure in the direction of the arrow 14.

At its mouth 12, the tube 4 has a diameter approximating to that of the loudspeaker drive unit 2 and its length is about the same as the diameter of the loudspeaker drive unit.

The tube extends rearwardly along the axis of the loudspeaker drive unit.

The loudspeaker drive unit is located on a central axis of the enclosure.

At the mouth 12 there is a significant change in acoustic impedance; acoustic impedance being defined as ro*c/area where ro is the density of air, c is the velocity of sound and area is the cross-sectional area of the body in question.

The enclosure 6 is generally spherical and has an internal volume of 8.1 liters. The tube 4 has an internal volume of 1.4 liters and tapers away exponentially from the mouth 12 with an exponential taper rate −11 and is approximately 30 centimeters long.

The illustrated loudspeaker system can be used for reproducing signals over a band 200 Herz to 7,000 Herz but for extremely high quality sound reproduction can be limited by cross-over circuitry to a band 400 Herz to 4,500 Herz. The fundamental resonance frequency of the tube (with its distal end closed) is approximately 570 Herz. If the closed end of the tube 4 is opened, the Helmholtz resonance frequency is 40 Herz and the fundamental resonance frequency of the tube is then 720 Hertz. The enclosure 6 has a fundamental resonance frequency of 800 Hertz.

Sound absorbent material, for example, glass fibre, illustrated diagrammatically as reference 16, is provided in the interior of the enclosure 6 and in the interior of the tube 4. The resonances of the enclosure and tube are damped by the sound absorbent material so as to reduce their Q factor and the overall effect is that the higher order resonances of the enclosure 6 counteract the higher order resonances of the tube 4. The distal end 18 of the tube 4 is closed.

Figure 2:
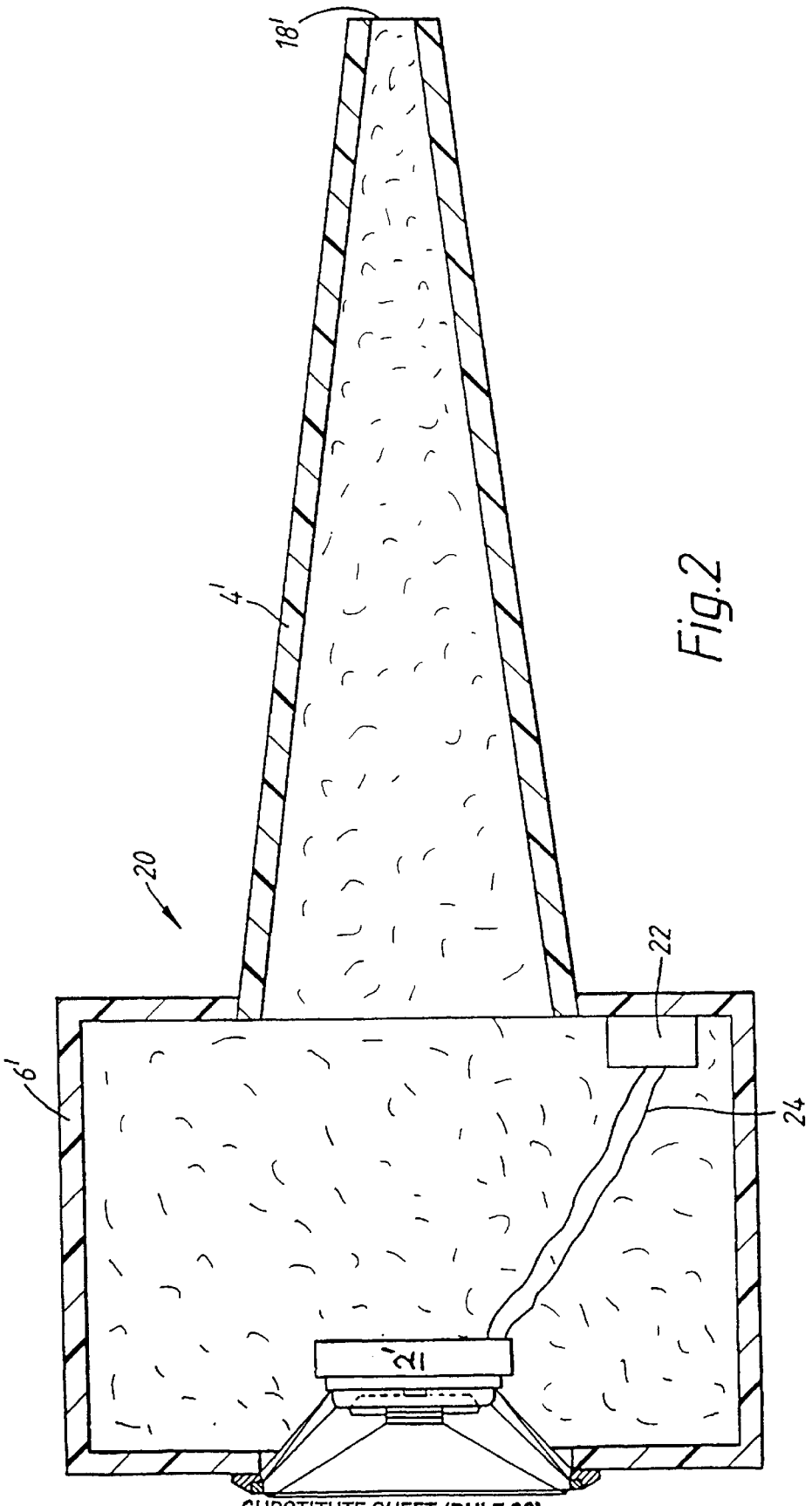
FIG. 2 is a diagrammatic cross-section through a second loudspeaker system in accordance with the invention.

In the second embodiment of the invention illustrated in FIG. 2, parts which correspond to parts of the first embodiment are given identical reference numerals and parts which are modified are given corresponding but primed reference numerals.

The system 20 shown in FIG. 2 includes a crossover network 22 defining the said first and second frequencies and connected to the loudspeaker drive unit 2' (which is of simple design without aerodynamic styling) by means of leads 24. The enclosure 6' is generally parallelepipedal and of rectangular section.

The tube 4' tapers away linearly and the distal end 18' of the tube is open.

A multi-way loudspeaker system can be constructed by combining several speaker systems 25 together with the crossover network 22 as shown in the above-mentioned earlier application, and illustrated schematically in FIG. 2. Each speaker system is arranged to reproduce a respective part of the audio spectrum. For example, a three-way loudspeaker system can be made with cross-over frequencies of 400 Herz and 4,500 Hertz.

If desired, a tube of constant section can be used in place of a tapering tube. The Helmholtz resonance frequency of an open-ended tube of constant section is defined as follows:

$$f_0=(c/2\pi)*(S/(V*l))\hat{0}0.5$$

where, $f_0$ is the Helmholtz resonance frequency, c is the velocity of sound,

S is the area of the tube ends, l is the length of the tube, and

V is the volume of the enclosure.

Any suitable shape can be chosen for the enclosure, for example, it can be a cube.

The loudspeaker drive unit can be mounted on any face of the enclosure as can the tube.

Instead of a single tube, a plurality of tubes, together equivalent to the single tube, can be provided.

What is claimed is:

1. A loudspeaker system for reproducing signals between a first, lower frequency and a second, higher frequency of the audio spectrum, the system comprising:

a loudspeaker drive unit and a tube acoustically coupled to the rear of the loudspeaker drive unit for leading away and absorbing sound waves produced at the rear of the loudspeaker drive unit, wherein:

the tube is acoustically coupled to the loudspeaker drive unit by means of a hollow resonant enclosure and the loudspeaker drive unit is mounted at an aperture in an external wall of the enclosure;

the tube communicates with the interior of the enclosure, extends outwardly from the enclosure, and is closed to the external surroundings along its length;

there is a significant change in acoustic impedance where the tube communicates with the interior of the enclosure;

a crossover network is provided to define the first, lower and second, higher frequencies of sound reproduction of the system;

the fundamental resonant frequencies of the enclosure and the tube each lie between the first, lower and second, higher frequencies of sound reproduction of the system but the Helmholtz resonant frequency of the tube, as hereinbefore defined, lies below the first, lower frequency of sound reproduction of the system, and means selected from a group consisting of (i) tapering away of the tube, (ii) closure of the distal end of the tube, and (iii) sound absorbent material are provided to prevent the emergence of sound waves from the distal end of the tube.

2. The system as claimed in claim 1, wherein the said Helmholtz resonant frequency is less than one half the first frequency.

3. The loudspeaker system as claimed in claim 1, wherein the fundamental resonance frequency of the tube is more than twice the first, lower frequency of sound reproduction of the system.

4. The loudspeaker system as claimed in claim 1, wherein said tube tapers away linearly.

5. The loudspeaker system as claimed in claim 1, wherein said tube tapers away exponentially.

6. The loudspeaker system as claimed in claim 1, wherein the distal end of said tube is open.

7. The loudspeaker system as claimed in claim 1, wherein the distal end of said tube is closed.

8. A loudspeaker system for reproducing signals between a first, lower frequency and a second, higher frequency of the audio spectrum, said system comprising:

a loudspeaker drive unit, a tube acoustically coupled to the rear of the loudspeaker drive unit for leading away and absorbing sound waves produced at the rear of the loudspeaker drive unit, said tube being acoustically coupled to the loudspeaker drive unit by means of a hollow resonant enclosure and said loudspeaker drive unit being mounted at an aperture in an external wall of the enclosure;

said tube communicating with the interior of the enclosure and extending outwardly from the enclosure;

the communication of said tube with the interior of the enclosure providing a significant change in acoustic impedance;

the fundamental resonant frequencies of the enclosure and the tube each lying between the first, lower and second, higher frequencies of sound reproduction of the system but the Helmholtz resonant frequency of the tube lying below the first, lower frequency of sound reproduction of the system, and means to prevent emergence of sound waves from the distal end of the tube.

9. The loudspeaker system as claimed in claim 8, wherein said means to prevent the emergence of sound waves from the distal end of said tube comprises a tapering away of said tube.

10. The loudspeaker system as claimed in claim 9, wherein said tapering away of said tube is an exponential tapering away.

11. The loudspeaker system as claimed in claim 8, wherein said means to prevent the emergence of sound waves from the distal end of said tube comprises a closed end to said tube.

12. The loudspeaker system as claimed in claim 8, wherein said means to prevent the emergence of sound waves from the distal end of said tube comprises sound absorbent material in a location selected from the group consisting of the interior of the enclosure, the interior of the tube, and the interior of both the enclosure and the tube.

13. The loudspeaker system as claimed in claim 8, wherein said loudspeaker drive unit is connected to a crossover network defining said first and second frequencies.

14. A loudspeaker system comprising:

a loudspeaker drive unit, a tube acoustically coupled to the rear of the loudspeaker drive unit for leading away and absorbing sound waves produced at the rear of the loudspeaker drive unit, said tube being acoustically coupled to the loudspeaker drive unit by means of a generally spherical hollow resonant enclosure and said loudspeaker drive unit being mounted at an aperture in an external wall of the enclosure;

said tube communicating with the interior of the enclosure, extending outwardly from the enclosure, and being closed to the external surroundings along its length; and means selected from a group consisting of (i) tapering away of the tube, (ii) closure of the distal end of the tube, and (iii) sound absorbent material to prevent the emergence of sound waves from the distal end of the tube.

15. The loudspeaker system as claimed in claim 14, wherein the system comprises a mid-range unit for reproducing signals between a first, lower frequency and a second, higher frequency of the audio spectrum, and the fundamental resonant frequencies of the enclosure and the tube each lie between the first, lower and second, higher frequencies of sound reproduction of the system but the Helmholtz resonant frequency of the tube lies below the first, lower frequency of sound reproduction of the system.

16. The loudspeaker system as claimed in claim 15, wherein said loudspeaker drive unit is connected to a crossover network defining said first and second frequencies.

17. The loudspeaker system as claimed in claim 14, wherein the distal end of said tube is closed.

18. The loudspeaker system as claimed in claim 15, wherein the said Helmholtz resonant frequency is less than one half the first frequency.

19. The loudspeaker system as claimed in claim 15, wherein the fundamental resonance frequency of the tube is more than twice the first, lower frequency of sound reproduction of the system.

* * * * *